US007263740B2

(12) United States Patent
Crisswell

(10) Patent No.: US 7,263,740 B2
(45) **Date of Patent: *Sep. 4, 2007**

(54) COMBINATION SQUEEGEE AND HAND TROWEL TOOL

(76) Inventor: Carl Crisswell, 1556 W. Tierrabuena La. 90, Phoenix, AZ (US) 85023

( * ) Notice: Subject to any disclaimer, the term of this patent is extended or adjusted under 35 U.S.C. 154(b) by 0 days.

This patent is subject to a terminal disclaimer.

(21) Appl. No.: 11/505,043

(22) Filed: Aug. 16, 2006

(65) Prior Publication Data

US 2006/0272117 A1 Dec. 7, 2006

Related U.S. Application Data

(63) Continuation of application No. 11/047,080, filed on Jan. 31, 2005, now abandoned.

(51) Int. Cl.
*A47L 13/02* (2006.01)
*B05C 17/10* (2006.01)

(52) U.S. Cl. ..... 15/236.05; 15/235.6; 15/236.07; 15/236.08; 30/169; 30/172

(58) Field of Classification Search ..... 15/235.6, 15/236.05, 236.07, 236.08; 30/169, 172; 134/8

See application file for complete search history.

(56) References Cited

U.S. PATENT DOCUMENTS

| | | | |
|---|---|---|---|
| 790,228 | A | 5/1905 | Rohrer |
| 1,490,766 | A | 4/1924 | Camden |
| 2,253,116 | A | 8/1941 | Findlay |
| 2,338,647 | A | 1/1944 | Koon |
| D156,638 | S | 12/1949 | Lifschutz |
| D221,244 | S | 7/1971 | Lawrence |
| 4,040,390 | A | 8/1977 | Rosenbaum |
| 4,355,432 | A | 10/1982 | Storm, Jr. |
| 4,627,128 | A | 12/1986 | Shea |
| 4,884,312 | A | 12/1989 | Clark |
| 4,987,635 | A | 1/1991 | Young |
| 5,101,529 | A | 4/1992 | Tippie |
| 5,201,121 | A | 4/1993 | Heiberg |
| D342,426 | S | 12/1993 | Concari |
| 5,309,598 | A | 5/1994 | Carpenter |
| 5,327,612 | A | 7/1994 | Kelsay |
| D349,222 | S | 8/1994 | Linden et al. |
| 5,450,648 | A | 9/1995 | Dovin et al. |
| 5,479,675 | A | 1/1996 | Pytlewski |
| 5,491,862 | A | 2/1996 | Hurley |
| D375,881 | S | 11/1996 | Spear et al. |
| D376,522 | S | 12/1996 | Tena |
| D384,251 | S | 9/1997 | Yeh |
| D395,385 | S | 6/1998 | Pipic |
| 5,779,475 | A | 7/1998 | Patel |
| 5,781,956 | A | 7/1998 | Kelsay et al. |

(Continued)

*Primary Examiner*—Randall Chin
(74) *Attorney, Agent, or Firm*—Dunlap Codding & Rogers

(57) ABSTRACT

The present invention is a combination squeegee (i.e., a scraper) and hand trowel tool. The tool can be conveniently used to first remove a material from a can, bucket or other material container and then used to spread the material evenly on a surface or substrate. The tool has a blade having a curved edge portion for removing material from cans or buckets and a separate notched edge portion (preferably with indentations or serrations) for evenly spreading the material on a surface. The invention further contemplates a method of using the tool to remove material from a can, bucket or container and applying the material to a surface.

6 Claims, 4 Drawing Sheets

U.S. PATENT DOCUMENTS 5,781,957 A 7/1998 Scholl
5,839,151 A 11/1998 Whaley
5,875,515 A 3/1999 Dallas
5,937,473 A 8/1999 Lisowski
6,178,586 B1 1/2001 Jafarmadar
6,205,610 B1 3/2001 Westthorp
6,640,378 B2 11/2003 Hsu

COMBINATION SQUEEGEE AND HAND TROWEL TOOL

CROSS-REFERENCE TO RELATED APPLICATIONS

This application is a continuation of U.S. Ser. No. 11/047,080, filed Jan. 31, 2005, now abandoned.

STATEMENT REGARDING FEDERALLY SPONSORED RESEARCH OR DEVELOPMENT

Not Applicable.

BACKGROUND OF THE INVENTION

The present invention generally relates to tools such as scrapers for removing residual material from cans, buckets or similar containers, and also generally relates to trowels for spreading materials on a surface.

The use of scrapers and trowels to remove various materials such as adhesives, grouts, cements, plaster, resin, stucco, paint and the like from cans, buckets or other containers is well known in the prior art. Examples of such scrapping tools are shown for example in U.S. Pat. Nos. 4,355,432; 4,627,128; 4,987,635; and 5,875,515. When using such scrapping tools to apply a material, some material is removed from the container with the tool, then the material is deposited upon the surface to which the material is to be applied such as a surface to be tiled. The user must then put the scrapping tool away and pick up a different tool such as a trowel which is then used to spread the material on the surface. This process of switching from one tool to another then back again can be time consuming and tedious. A tool which functioned to improve the efficiency of this process would be desirable.

SUMMARY OF THE INVENTION

The present invention is a combination squeegee (i.e., a scraper) and hand trowel tool. The tool can be conveniently used to first remove a material from a can, bucket or other material container and then used to spread the material evenly on a surface or substrate. The tool has a substantially flat blade having a continuous arcuate curved edge portion substantially conforming to a portion of an interior wall of a container for efficiently removing residual material from the interior wall of containers such as cans or buckets and a separate notched edge portion (preferably with indentations or serrations) for evenly spreading the material on a surface. The invention further contemplates a method of using the tool to remove material from a can, bucket or container and applying the material to a surface.

DETAILED DESCRIPTION OF THE INVENTION

Figure 1:
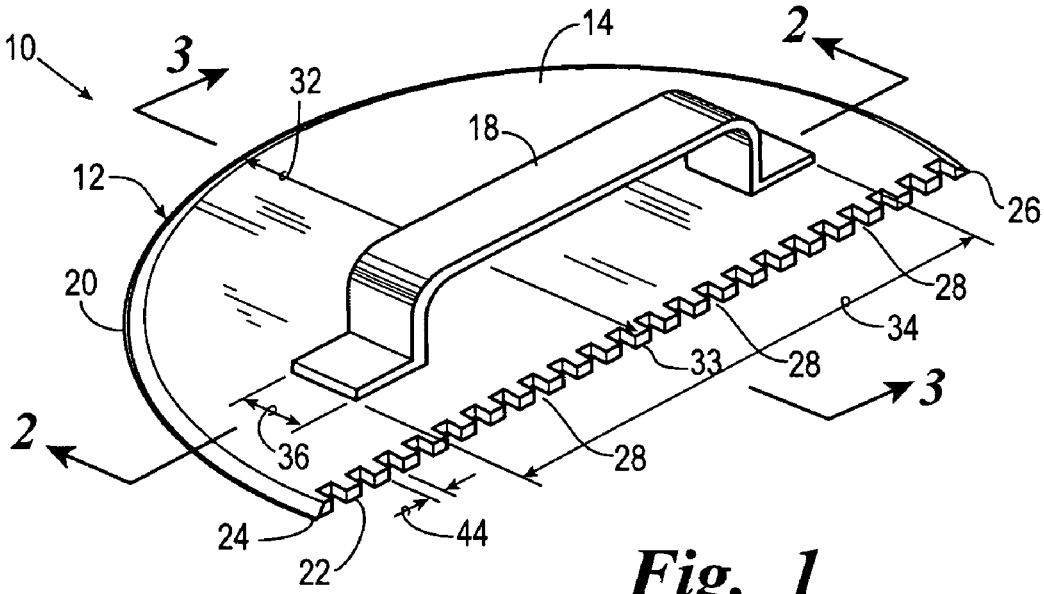
FIG. 1 is a perspective view of a combination squeegee and hand trowel constructed in accordance with the present invention.
Figure 2:
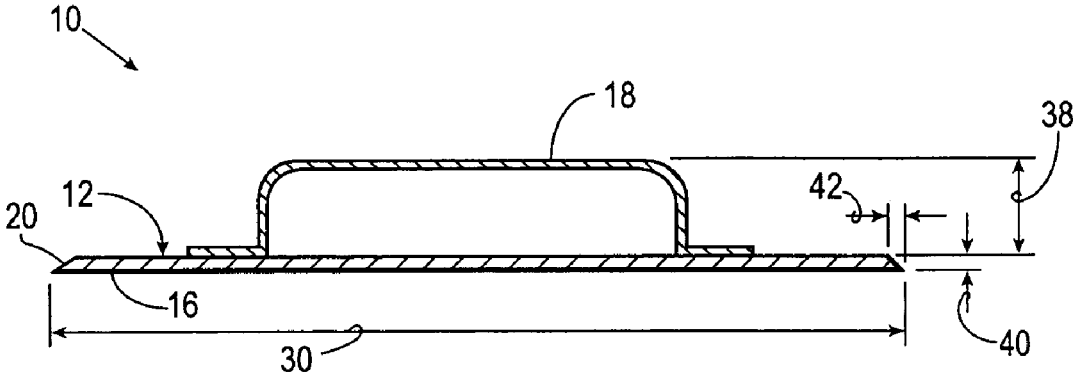
FIG. 2 is a cross-sectional view of the combination squeegee and hand trowel of FIG. 1 taken along line 2-2 thereof.
Figure 3:
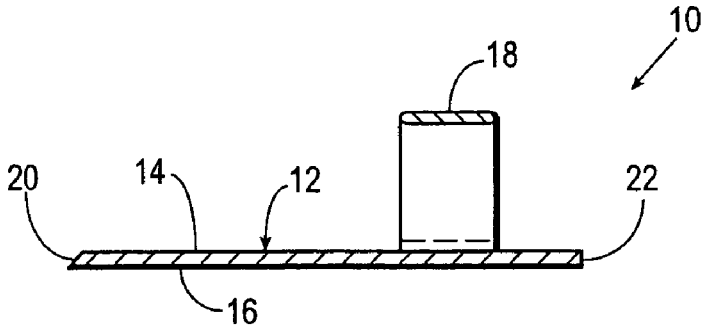
FIG. 3 is a cross-sectional view of the combination squeegee and hand trowel of FIG. 1 taken along line 3-3 thereof.

Referring now to the drawings, and more particularly to FIGS. 1-3, shown therein is a combination squeegee and hand trowel 10 constructed in accordance with the present invention. The combination squeegee and hand trowel 10 (hereinafter also referred to as tool) is provided with a substantially flat blade 12 having an upper surface 14 and a lower surface 16. A handle 18 is connected to the flat blade 12 so as to extend upwardly from the upper surface 14 of the blade 12 so that a person can grasp the handle 18. The handle 18 can be releaseably or non-releaseably connected to the blade 12 of the tool 10.

As shown in FIG. 1, the blade 12 has a semi-circular configuration (i.e. the shape of a half-circle) and has a curved edge 20 and a notched edge 22. The curved edge 20 is a continuous arc which extends from a first end 24 of the notched edge 22 to a second end 26 of the notched edge 22. That is, the blade 12 is provided with a continuous arcuate curved edge 20 and the curved edge 20 of the blade 12 is sized to substantially correspond to a portion of a curved interior sidewall of the container for which the blade 12 is used to remove material from the interior sidewall of the container as will be described in more detail hereinafter.

The notched edge 22 includes a plurality of notches 28, only a portion of which are specifically indicated by a reference numeral. The configuration of the notched edge 22 can vary widely and will depend, to a large extent, on what the tool 10 is to be used for. For example, the notched edge 22 is shown in FIG. 2 as being crenelate, a desired configuration when using the tool 10 to apply an adhesive to a surface, such as when laying tile.

The blade 12 has a length 30 and a width 32 which extends perpendicularly from a center point 33 of the notched edge 22 to the curved edge 20. The length 30 and width 32 of the blade 12 will vary depending on the size of the container with which the blade 12 is used to scrape material from the sidewall of the container. That is, the blade 12 is provided with a sufficient length 30 and a sufficient width 32 so that the curved edge 20 of the blade 12 can be disposed substantially adjacent a portion of the curved interior surface or wall of the container whereby a material on the sidewall can be removed by the tool 10. For example, when using the tool 10 to remove material from the sidewall of a conventional five gallon bucket, desirable results have been obtained wherein the blade 12 of the tool 10 is provided with a length of about 10.25 inches and a width of about 6.75 inches.

As previously stated, the curved edge 30 of the blade 12 has a continuous curvature which conforms to or compliments the curvature of an inner surface of a side wall of a container with which the tool 10 is anticipated to be used. That is, the curved edge 30 of the blade 12 is void of any straight line segments. Thus, the particular size of the blade 12 of the tool 10 will be determined based upon the size of the container with which the tool 10 is to be used. Further, the material removed from the container can be tile adhesives, grouts, stucco, plaster, or other bonding materials as well as paints which are used in construction. Such containers are well known in the art. Thus, no further discussion concerning the size of such containers or the nature of such containers is deemed necessary.

As noted above, the handle 18 of the tool 10 is sized to permit a person to grip the handle so that the tool 10 can be used to scrape material from the inner surface of the sidewall of the container. Thus, the handle 18 has a length 34, a width 36 and a height 38. The length 34, width 36 and height 38 of the handle 18 can vary widely depending on the size of the blade 12. For example, desirable results have been obtained wherein the length 34 of the handle 18 is about 6.75 inches, the width 36 is about 1 inch and the height 38 is about 1.5 inches.

To enhance removal of material from the interior surface of the sidewall of the container, the curved edge 20 of the blade 12 is desirably beveled substantially as shown. The degree of beveling of the curved edge 20 of the blade 12 can vary widely. However, desirable results have been achieved wherein the curved edge 20 of the blade 12 has a bevel height 40 of about 0.125 inch and a bevel width 42 of about 0.25 inch.

As previously noted, the notched edge 22 of the blade 12 is provided with a plurality of notches 28. Each notch 28 has a notch width 44. The notched edge 22 of the blade 12 shown in FIGS. 1-3 has a crenelate shape. The distance between the notches 28 of the notched edge 22 can vary widely depending on the intended use of the tool 10, as can the width of the notches 28. For example, the notches 28 can be provided with a notched width 40 of about 0.25 inches.

Figure 4:
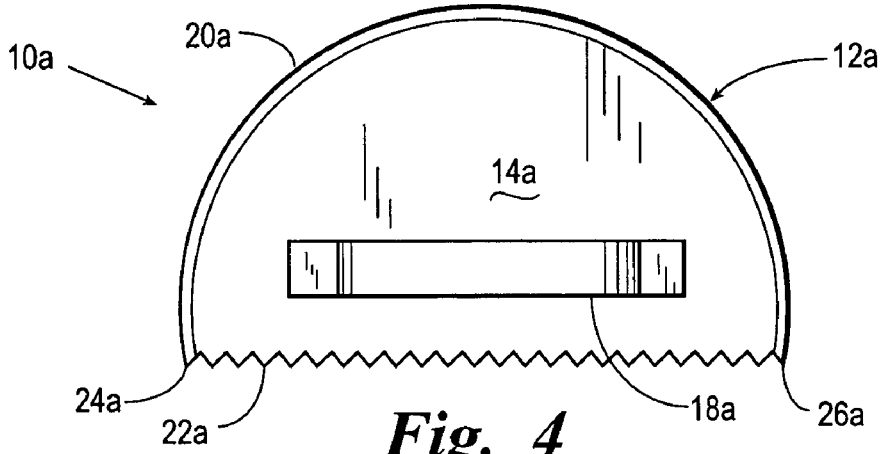
FIG. 4 is a plan view of another embodiment of a combination squeegee and hand trowel constructed in accordance with the present invention.
Figure 5:
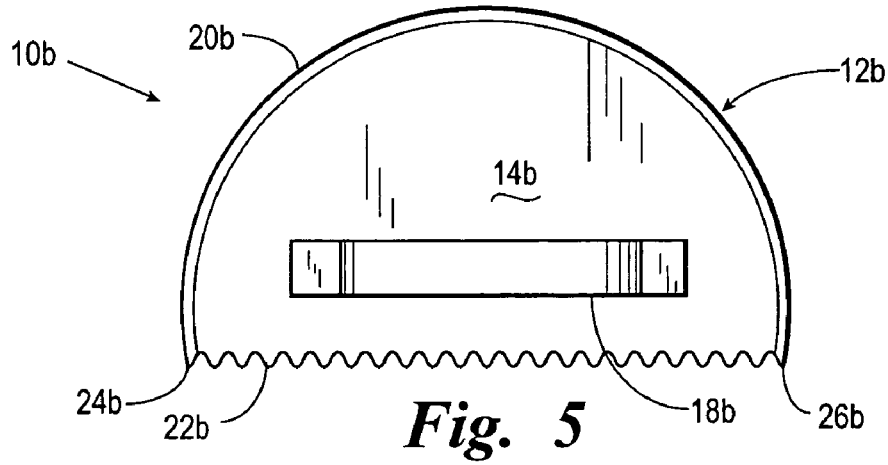
FIG. 5 is a plan view of another embodiment of a combination squeegee and hand trowel constructed in accordance with the present invention.
Figure 6:
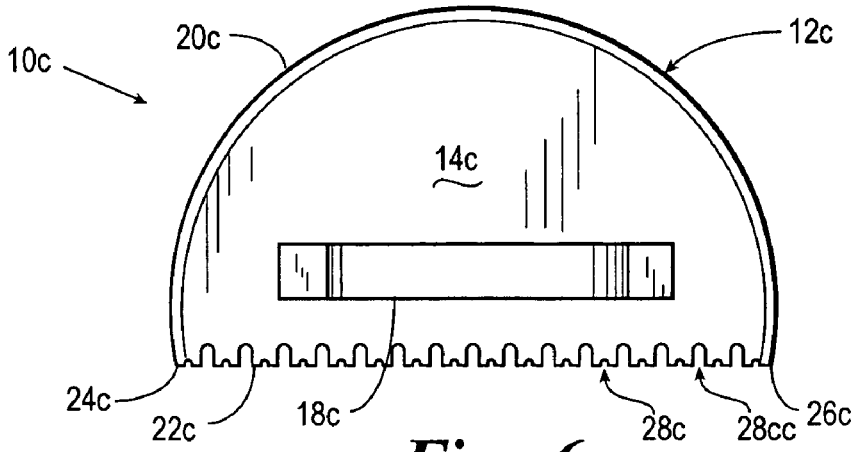
FIG. 6 is a plan view of another embodiment of a combination squeegee and hand trowel constructed in accordance with the present invention.

Referring now to FIGS. 4-6, shown therein are three additional embodiments of a tool constructed in accordance with the present invention wherein the notched edges of the tools have alternate notch patterns. Shown in FIG. 4 is a tool 10*a* having a flat blade 12*a*. The blade 12*a* has a handle 18*a* connected to an upper surface 14*a* of the blade 12*a* such that the handle 18*a* extends upwardly therefrom. The blade 12*a* has a semi-circular configuration, and as such has a curved edge 20*a* and a notched edge 22*a*. The curved edge 20*a* is a continuous arc which extends from a first end 24 of the notched edge 22*a* to a second end 26*a* of the notched edge 22*a*. Thus, with exception of the configuration of the notched edge 22*a*, the blade 12*a* of the tool 10*a* is similar in construction and functioned to the blade 12 of the tool 10 hereinbefore described with reference to FIGS. 1-3. That is, the notched edge 22*a* of the blade 12*a* of the tool 10*a* has a serrated or "toothed" pattern rather than the notched pattern of the blade 12 of the tool 10.

Referring now to FIG. 5, shown therein is a tool 10*b* constructed in accordance with the present invention. The tool 10*b* is provided with a flat blade 12*b* having a handle 18*b* connected to an upper surface 14*b* of the blade 12*b* such that the handle 18*b* extends upwardly therefrom. The blade 12*b* has a semi-circular configuration and as such has a curved edge 20*b* and a notched edge 22*b*. The curved edge 20*b* is a continuous arc which extends from a first end 24*b* of the notched edge 22*b* to a second end 26*b* of the notched edge 22*b*. Thus, with exception of the configuration of the notched edge 22*b*, the blade 12*b* of the tool 10*b* is similar in construction and function to the blade 12 of the tool 10 hereinbefore described with reference to FIGS. 1-3. That is, the notched edge 22*b* of the blade 12*b* of the tool 10*b* has a crenelate or scalloped pattern which is "curved" or "wavy".

Referring now to FIG. 6, shown therein is a tool 10*c* constructed in accordance with the present invention. The tool 10*c* has a flat blade 12*c*. The blade 12*c* has a handle 18*c* connected to an upper surface 14*c* of the blade 12*c* such that the handle 18*c* extends upwardly therefrom. The blade 12*c* has a semi-circular configuration and as such has a curved edge 20*c* and a notched edge 22*c*. The curved edge 20*c* is a continuous arc which extends from a first end 24*c* of the notched edge 22*c* to a second end 26*c* of the notched edge 22*c*. Thus, with exception of the configuration of the notched edge 22*c*, the blade 12*c* of the tool 10*c* is similar in construction and function to the blade 12 of the tool 10 hereinbefore described with reference to FIGS. 1-3. That is, the notched edge 22*c* of the blade 12*c* of the tool 10*c* has a pattern wherein smaller notches 28*c* alternate with larger notches 28*cc*.

While certain patterns for the notched edge of the tools hereinbefore described have been shown, it will be readily apparent to those skilled in the art that other notch patterns can be employed in the construction of the notched edge of the tool of the present invention.

Figure 7:
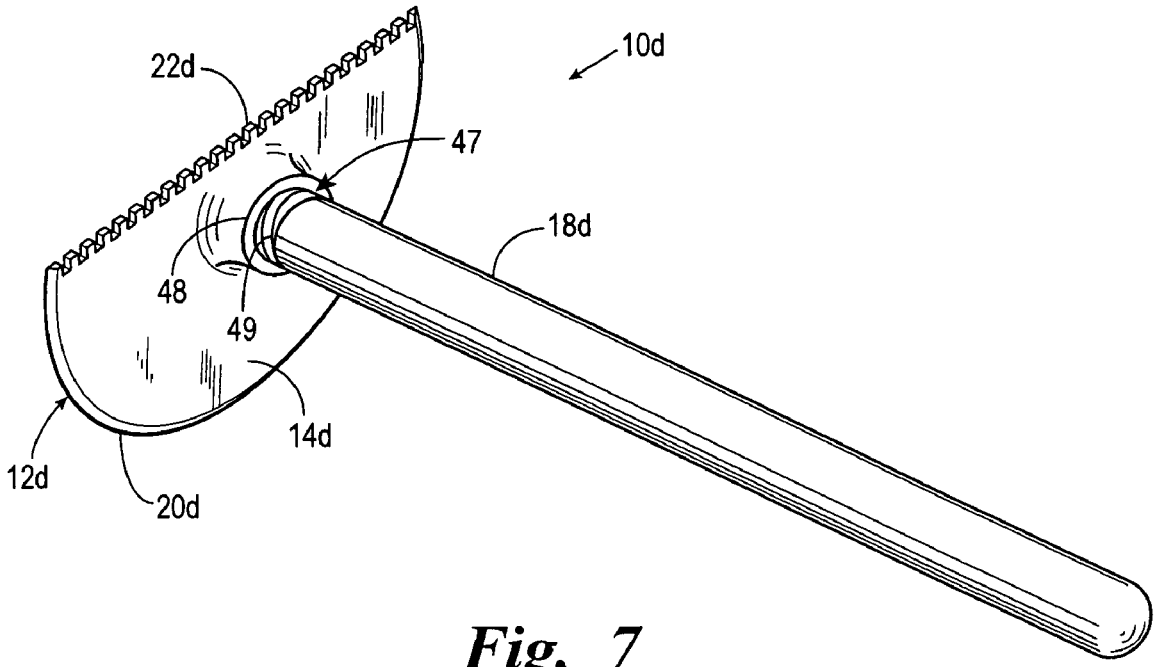
FIG. 7 is a perspective view yet another embodiment of a combination squeegee and hand trowel constructed in accordance with the present invention.

As noted before, the handle 18 of the tool 10 may be releaseably connected, i.e. detachable, from the blade 12. Shown in FIG. 7 is a tool 10*d* which includes a blade 12*d*, a handle 18*d* and a connector assembly 47 for connecting the handle 18*d* to the blade 12*d*. The blade 12*d* is provided with a curved edge 20*d* and a notched edge 22*d*. The blade 12*d* of the tool 10*d* may be the same as the blade of any other tool described herein. The tool 10*d* differs from the tools 10-10*c* described herein in that the handle 18*d* is detachably connected to the blade 12*d*.

The connector assembly 47 includes a female connector 48 and a male connector 49. The female connector 48 is formed integrally with the blade 12*d* so as to extend outwardly from an upper surface 14*d* of the blade 12*d* substantially as shown. The male connector 49 is formed on one end of the handle 18*d* and is adapted to matingly engage the female connector 48 so that the handle 18*d* can be connected to the blade 12*d*.

Any suitable mechanism can be used as the connector assembly 47. For example, the female connector 48 can include a housing having an opening therein with internally disposed threads and the male connector 49 can be a threaded portion on one end of the handle 18 which can be inserted within the housing for mating engagement with the threads in the housing of the female connector 48 substantially as shown. Thus, the handle 18*d* can be operably connected or disconnected from the blade 12*d* via the connector assembly 47.

Any of the tools 10-10*d* contemplated herein or alternate embodiments of them may be constructed of materials known to be used in the construction of trowels, squeegees, scrapers, or the like, including metals, polymers, plastics (including thermoplastics), rubber, wood, wood products, cardboard, or combinations thereof. The tools 10-10*d* may be flexible or rigid. The tools described herein, such as tools 10-10*c*, may be formed as an integral one piece construction molded from a thermoplastic material, although the tool 10*d* is shown as constructed of separate materials such as a separate blade 12*d* and a separate handle 18*d* which are connected together via the connector assembly 47 hereinbefore described.

Figure 8:
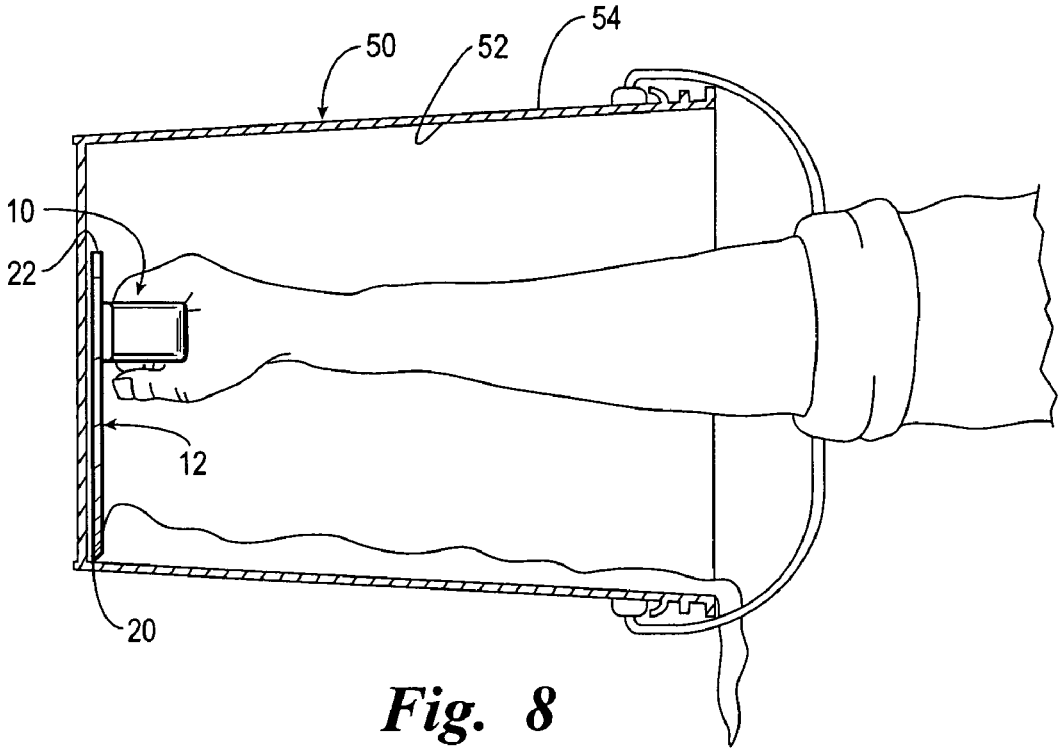
FIG. 8 is a side cross-sectional view showing the use of the tool of FIG. 1 for removing material from an interior wall of a container.
Figure 9:
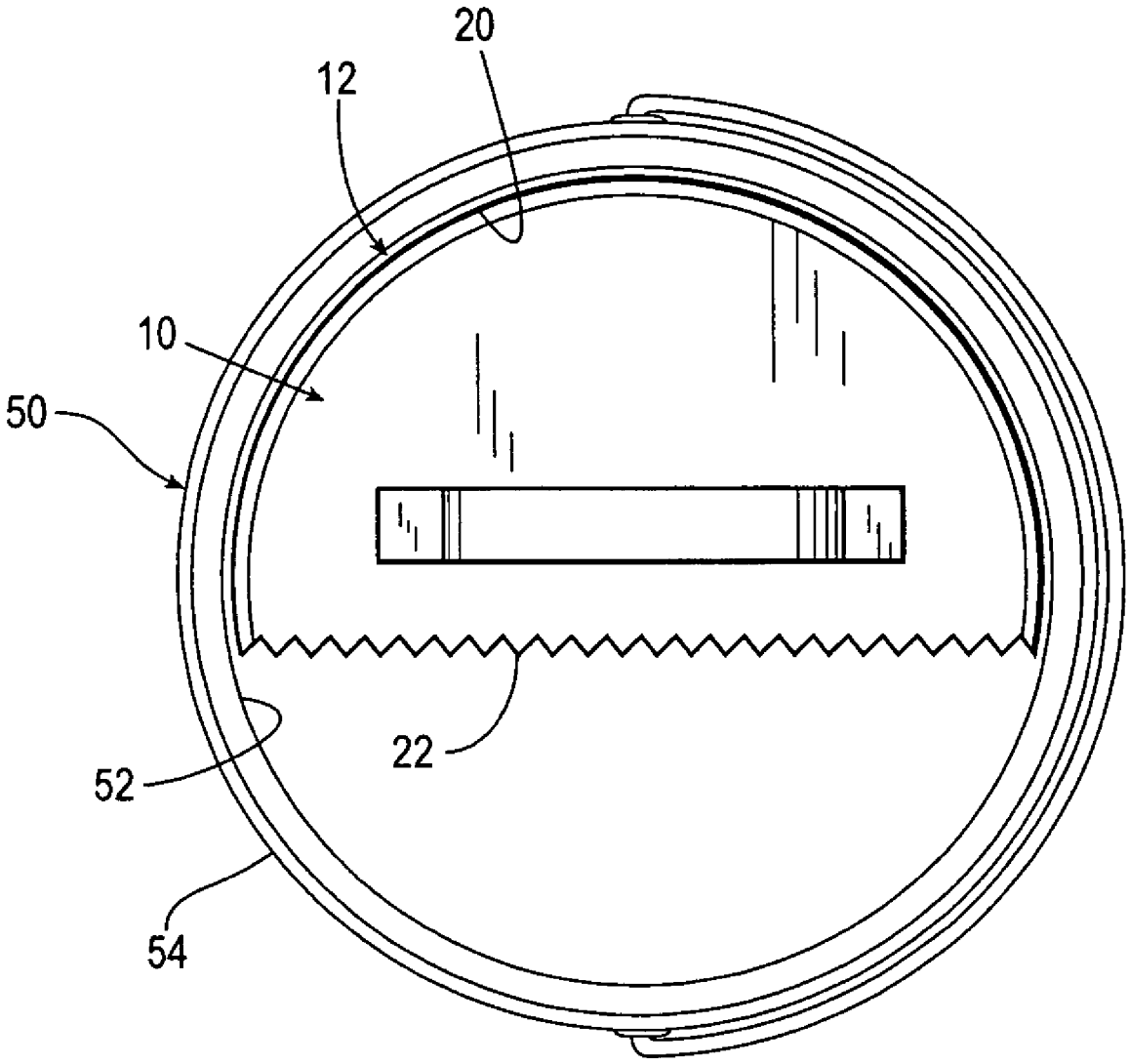
FIG. 9 is a top plan view illustrating a curved edge portion of the combination squeegee and hand trowel disposed substantially adjacent an interior wall of a container.

Referring now to FIGS. 8 and 9, the manner of usage and operation of the combination squeegee and hand trowel of the present invention will now be described with reference to the tool 10. Once a cylindrically shaped container 50, such as a gallon bucket, a 5 gallon bucket or a 10 gallon bucket has been opened, the tool 10 is inserted into the container 50 to remove material therefrom. Once the container 50 has been substantially emptied the curved edge 20 of the tool 10, which is arcuately shaped to substantially correspond to an arc configuration of a segment of an inner surface 52 of a sidewall 54 of the container 50, is positioned adjacent the segment of the inner surface 52 of the sidewall 54 and the interior surface 52 of the sidewall 54 is scraped with the curved edge 20 of the tool 10 to remove residual material from the inner surface 52 of the sidewall 54. The scraping motion utilizing the curved edge 20 of the tool 10 is repeated until substantially all the material has been removed from the inner surface 52 of the sidewall 54 of the container 50. It should be noted that the tool 10 may also be used to remove residual amounts of material from the bottom of the container 50 or from beneath an interior rim of the container 50. As such, removal of substantially all material within the container 50 can be effected utilizing the tool 10 (or any other tool of the present invention). Furthermore, the tools described herein can be utilized to spread or otherwise apply material removed from a container, such as the container 50, to a surface or substrate in a manner appropriate for the material. That is, the notched edge 22 of the blade 12 of the tool 10 can be utilized to effectively spread material removed from the container 50 as required for a particular application.

The size of the container 50 can vary widely but the container 50 will typically be of a size used in various manners of construction and remodeling. Further, the size of the tool 10 and any other tools described herein, will vary and desirably be sized and configured to enhance removal of material from the interior surface 52 of the sidewalls 54 of the container 50.

It is to be understood that the dimensional relationships of the materials from which the tools 10-10*d* and the handles 18 and 18*d* are fabricated, and the components of the tools 10-10*d* of the invention such as the blades 12-12*d* or the handles 18 and 18*d*, can vary, as well as the configuration of the handles 18 and 18*d* of the tools 10-10*d*.

Therefore, the foregoing is considered as illustrative only of the tools 10-10*d* of the present invention. Further, since numerous modifications and changes will readily occur to those skilled in the art, the tools 10-10*d* and their uses are not limited to the exact construction and operation shown and described, and all suitable modifications and equivalents of the tools 10-10*d* described herein may be resorted to, and fall within the scope of the present invention.

What is claimed is:

1. A combination squeegee and trowel tool, comprising:

a substantially flat blade having an upper surface, a lower surface, a continuous arcuate curved edge and a notched straight edge comprising a plurality of notches, the notched edge having a first end and a second end and the continuous arcuate curved edge extending from the first end of the notched edge to the second end of the notched edge, the continuous arcuate curved edge having a constant radius from a point centrally located between the first end and the second end of the notched edge, the continuous arcuate curved edge substantially corresponding to a segment of an inner surface of a sidewall of a container in which the flat blade is used to remove residual material from the inner surface of the sidewall of the container; and a handle connected to the flat blade via the upper surface thereof for enhancing a scraping action by the continuous arcuate curved edge of the flat blade for removal of residual material from the inner surface of the sidewall of the container.

2. The combination squeegee and trowel tool of claim 1 wherein the notched edge comprises a plurality of crenelate notches, serrated notches, crenate notches, scalloped notches, curved notches, or wavy notches, or combinations thereof.

3. The combination squeegee and trowel tool of claim 2 wherein the continuous arcuate curved edge of the blade is beveled.

4. The combination squeegee and trowel tool of claim 1 wherein the continuous arcuate curved edge of the blade is beveled.

5. The combination squeegee and trowel tool of claim 1 wherein the handle is of unitary construction with the flat blade.

6. The combination squeegee and trowel tool of claim 1 wherein the handle is detachably connected to the upper surface of the blade.

* * * * *